US010527378B1

(12) United States Patent
Christian

(10) Patent No.: US 10,527,378 B1
(45) Date of Patent: Jan. 7, 2020

(54) FINGERPRINT GUN LOCK APPARATUS

(71) Applicant: Gary Christian, Boulder City, NV (US)

(72) Inventor: Gary Christian, Boulder City, NV (US)

( * ) Notice: Subject to any disclaimer, the term of this patent is extended or adjusted under 35 U.S.C. 154(b) by 0 days.

(21) Appl. No.: 16/437,747

(22) Filed: Jun. 11, 2019

(51) Int. Cl.
*F41A 17/54* (2006.01)
*F41A 17/06* (2006.01)
*F41A 17/46* (2006.01)

(52) U.S. Cl.
CPC ..... *F41A 17/066* (2013.01); *F41A 17/46* (2013.01)

(58) Field of Classification Search
CPC ..... F41A 17/54; F41A 17/48; F41A 17/06; F41A 17/46; F41A 17/066
USPC ..... 42/70.07
See application file for complete search history.

(56) References Cited

U.S. PATENT DOCUMENTS 4,995,180 A * 2/1991 Tucker ..... F41A 17/02 42/70.07
8,991,087 B2 * 3/2015 Ruffin ..... F41A 17/066 42/70.06
9,651,325 B1 5/2017 Gant
2014/0259841 A1 9/2014 Carlson
2016/0054081 A1 2/2016 Creed
2016/0054083 A1 * 2/2016 Kiyani ..... F41A 17/063 42/70.11
2017/0343310 A1 * 11/2017 Reiss ..... F41A 17/063
2018/0031345 A1 2/2018 Winiecki

* cited by examiner

*Primary Examiner* — Reginald S Tillman, Jr.

(57) ABSTRACT

A fingerprint gun lock apparatus for quickly and safely locking and unlocking a trigger of a gun includes a frontside body having a frontside inner face with an extended portion and a recessed portion. A screw gear is coupled to a motor within a frontside inner cavity. A pair of locking pins each has a threaded end coupled to the screw gear, extends through a pair of pin apertures, and has a hooked distal end. The pair of locking pins secures a backside body to the frontside body around the trigger of the gun. A fingerprint scanner activates the motor to turn the screw gear and separate the pair of locking pins when an authorized fingerprint is touched to the scan side to allow the frontside body and the backside body to separate.

9 Claims, 5 Drawing Sheets

FINGERPRINT GUN LOCK APPARATUS

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to gun locks and more particularly pertains to a new gun lock for quickly and safely locking and unlocking a trigger of a gun.

BRIEF SUMMARY OF THE INVENTION

An embodiment of the disclosure meets the needs presented above by generally comprising a frontside body having a frontside outer face separated from a frontside inner face, a frontside top face separated from a frontside bottom face, and a frontside back face separated from a frontside front face defining a frontside inner cavity. The frontside inner face has an extended portion adjacent the frontside front face and a recessed portion adjacent the frontside back face. The extended portion has an inner wall parallel with the frontside front face. The inner wall has a length configured to be greater than a width of a trigger guard of a gun. The recessed portion of the frontside inner face has a pair of pin apertures extending through to the frontside inner cavity. A motor is coupled to the frontside body within the frontside inner cavity and a screw gear is coupled to the motor. The screw gear extends into the recessed portion and is in operational communication with the motor. A pair of locking pins each has a threaded end coupled to the screw gear, extends through the pair of pin apertures, and has a hooked distal end. The pair of locking pins moves together and alternatively moves apart between a closed position and an alternative open position as the screw gear is rotated. A microprocessor is coupled within the frontside inner cavity and is in operational communication with the motor. A plurality of batteries is coupled within the frontside inner cavity and is in operational communication with the motor and the microprocessor. A fingerprint scanner is coupled within the frontside inner cavity and has a scan side extending through the frontside back face. The fingerprint scanner is in operational communication with the microprocessor to activate the motor to turn the screw gear and separate the pair of locking pins to the open position when an authorized fingerprint is touched to the scan side. A backside body has a backside outer face separated from a backside inner face, a backside top face separated from a backside bottom face, and a backside back face separated from a backside front face defining a backside inner cavity. The backside inner face has a pair of receiving apertures extending through to the backside inner cavity. The pair of receiving apertures selectively receives the pair of locking pins. The pair of locking pins secures a median portion between the pair of receiving apertures in the closed position and presses the extended portion of the frontside inner face against the backside inner face. The pair of locking pins is removable from the pair of receiving apertures in the open position. The frontside body and the backside body are configured to secure each side of the trigger guard with the pair of locking pins extending around each side of a trigger of the gun to prevent the gun from being fired.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
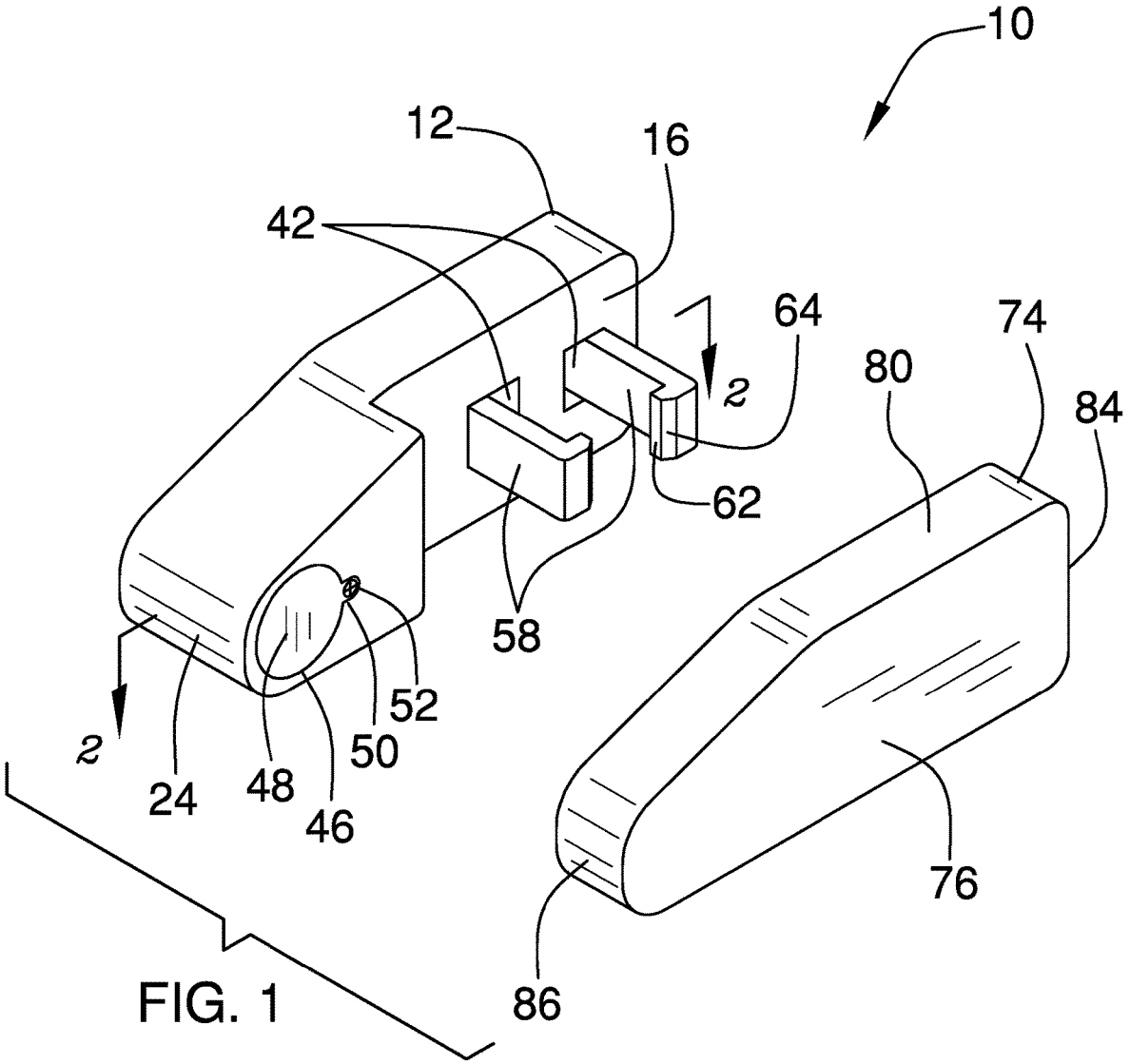
FIG. 1 is an isometric view of a fingerprint gun lock apparatus according to an embodiment of the disclosure.
Figure 2:
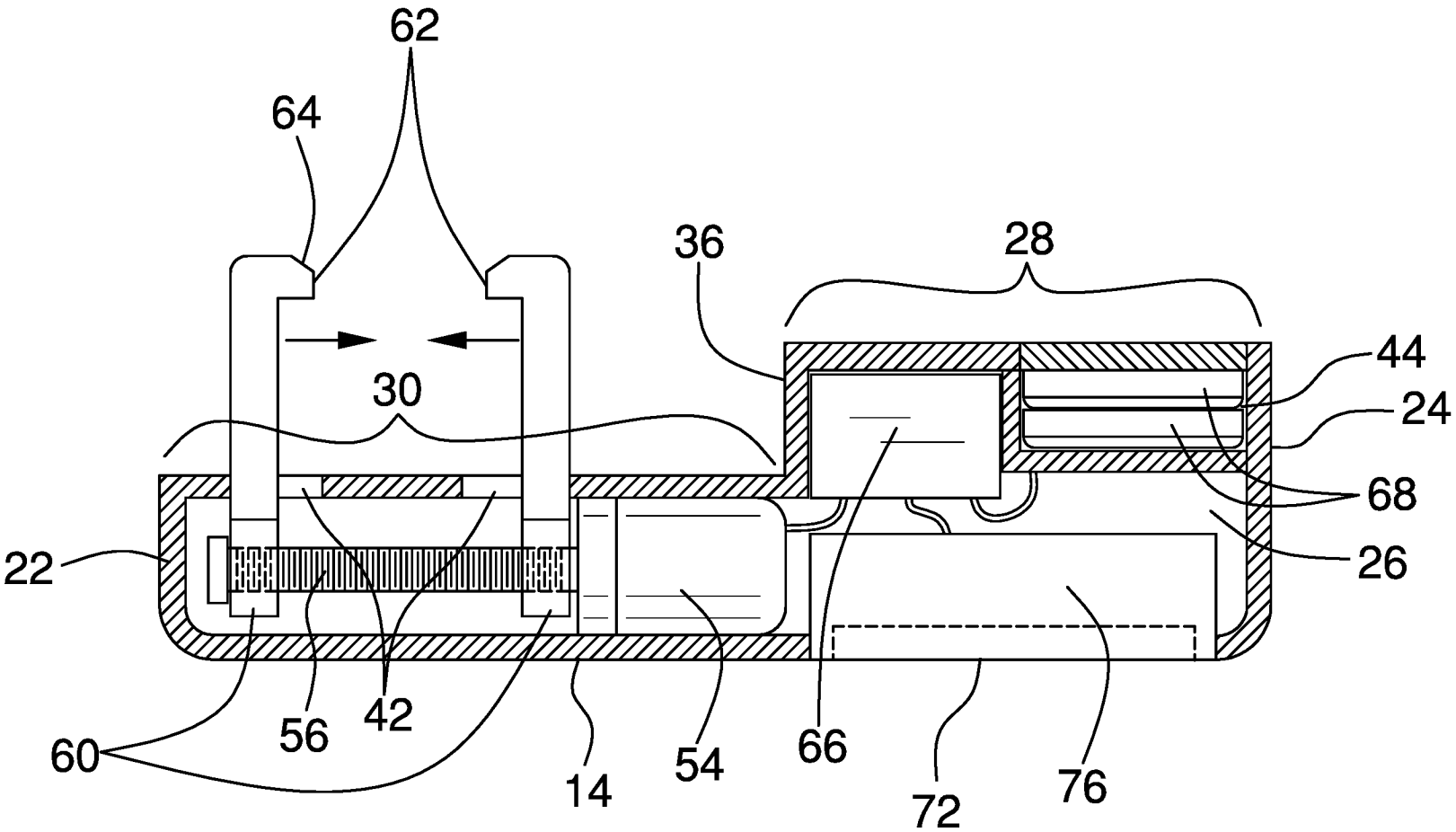
FIG. 2 is a cross-sectional view of an embodiment of the disclosure.
Figure 3:
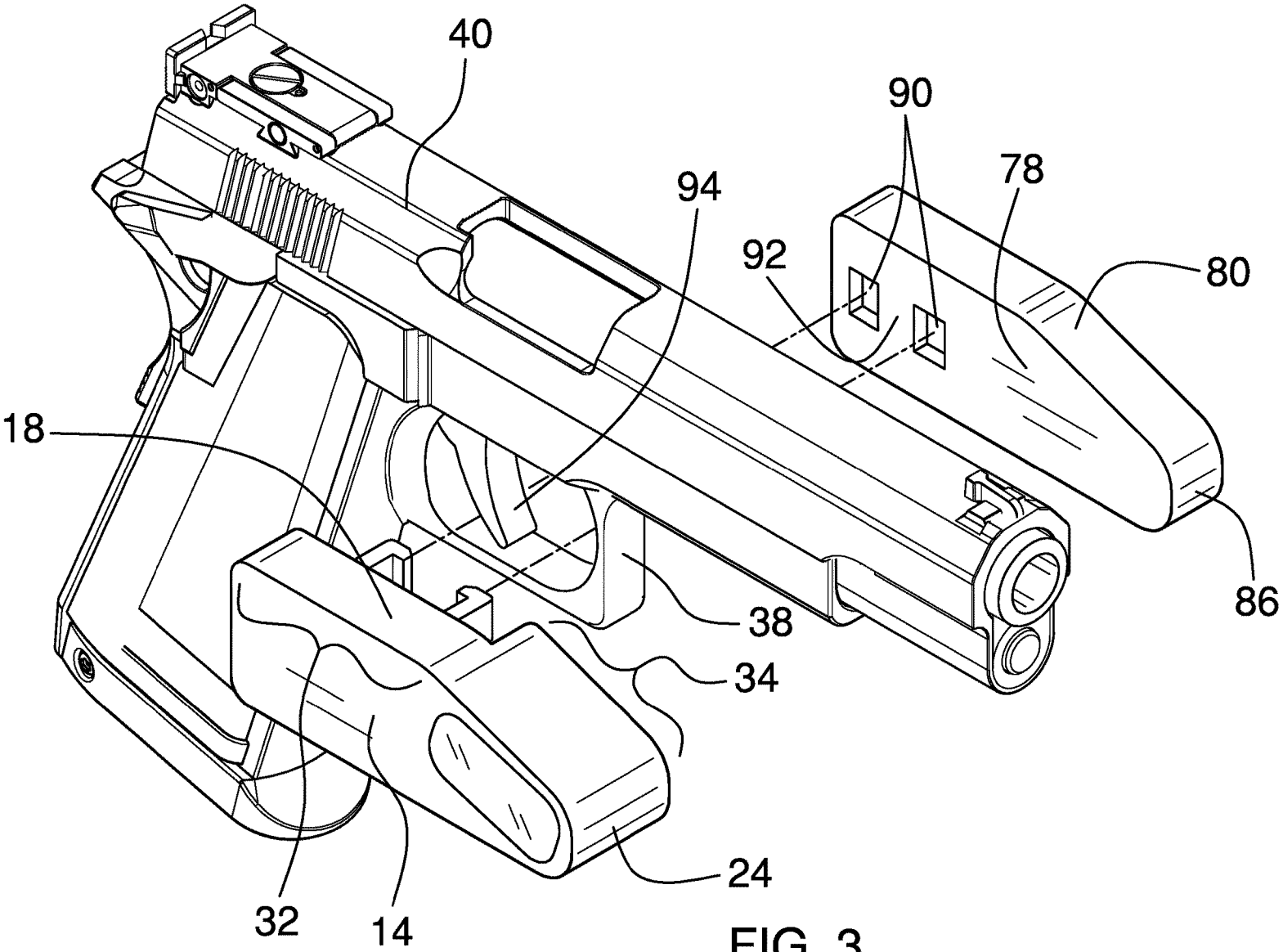
FIG. 3 is an exploded in-use view of an embodiment of the disclosure.
Figure 4:
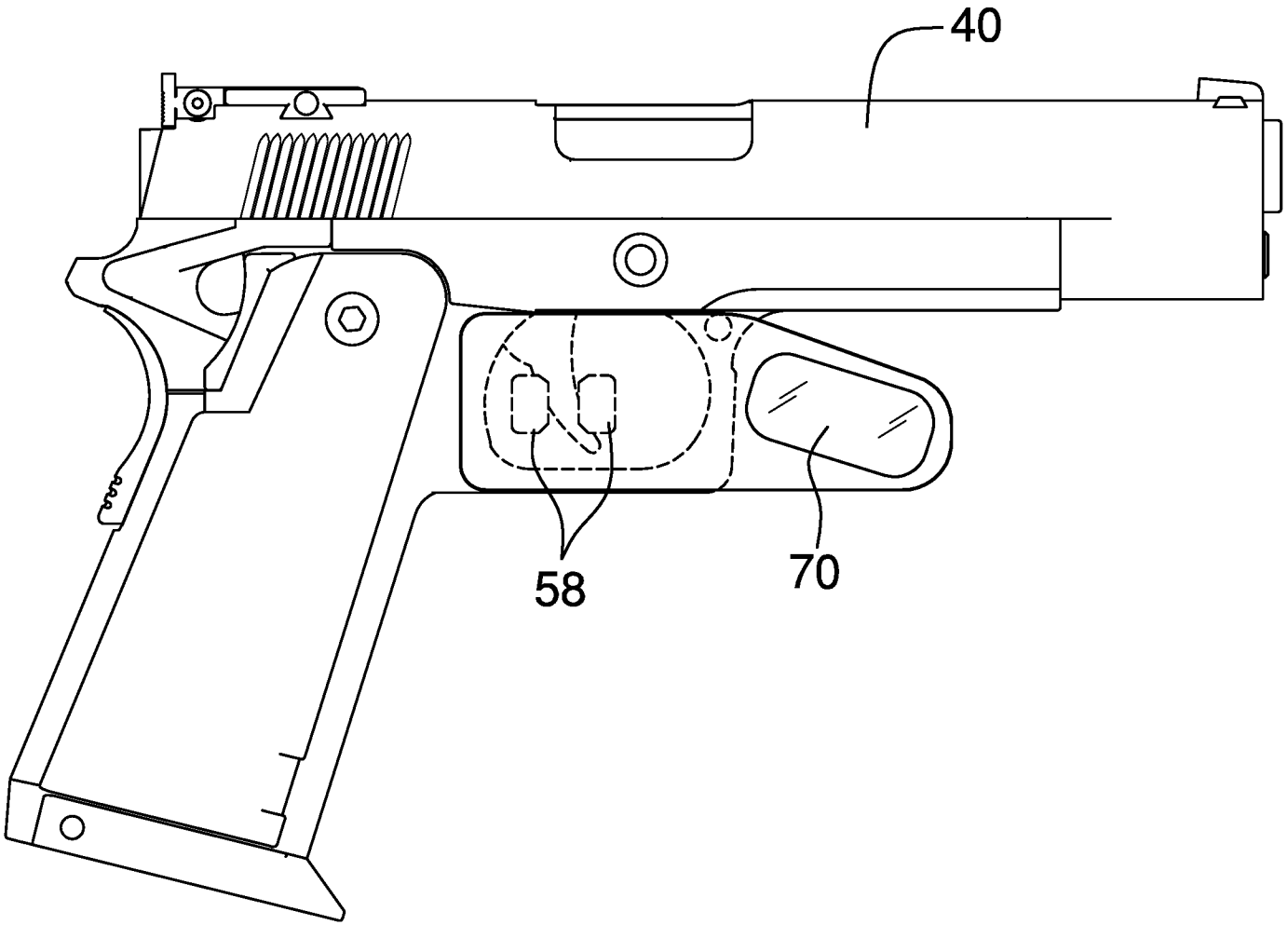
FIG. 4 is a side elevation in-use view of an embodiment of the disclosure.
Figure 5:
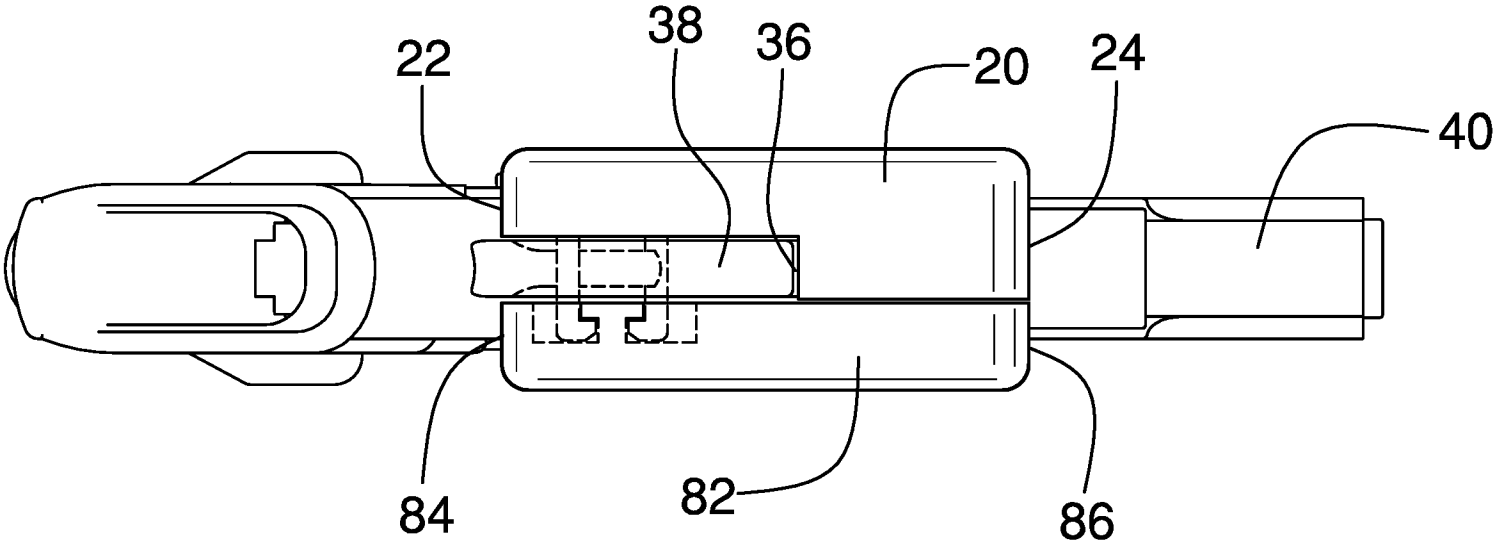
FIG. 5 is a bottom plan in-use view of an embodiment of the disclosure.

With reference now to the drawings, and in particular to FIGS. 1 through 5 thereof, a new gun lock embodying the principles and concepts of an embodiment of the disclosure and generally designated by the reference numeral 10 will be described.

As best illustrated in FIGS. 1 through 5, the fingerprint gun lock apparatus 10 generally comprises a frontside body 12 having a frontside outer face 14 separated from a frontside inner face 16, a frontside top face 18 separated from a frontside bottom face 20, and a frontside back face 22 separated from a frontside front face 24 defining a frontside inner cavity 26. The frontside inner face 16 has an extended portion 28 adjacent the frontside front face 24 and a recessed portion 30 adjacent the frontside back face 22. The frontside top face 18 has a parallel portion 32 and an angled portion 34. The parallel portion 32 is parallel the frontside bottom face 20 and extending along the recessed portion 30 and the angled portion 34 extends towards the frontside bottom face 20 along the extended portion 28. The extended portion 28 has an inner wall 36 parallel with the frontside front face 24. The inner wall 36 has a length configured to be greater than a width of a trigger guard 38 of a gun 40. The recessed portion 30 of the frontside inner face has a pair of rectangular pin apertures 42 extending through to the frontside inner cavity 26. The frontside inner cavity 26 has a battery compartment 44 within the extended portion 28 and the frontside inner face 16 has a battery aperture 46 extending through to the battery compartment 44. A battery cover 48 is coupled to the frontside body 12. The battery cover 48 is circular and has a fastener extension 50 to receive a fastener 52 to selectively engage the frontside inner face 16. The battery cover is selectively engageable with the battery aperture 46 to cover and alternatively expose the battery compartment 44.

A motor 54 is coupled to the frontside body 12 within the frontside inner cavity 26. A screw gear 56 is coupled to the motor 54 and extends into the recessed portion 30 behind the pair of pin apertures 42. The screw gear 56 is in in operational communication with the motor 54 to be rotated in both directions. A pair of locking pins 58 each has a threaded end 60 coupled to the screw gear 56, extends through the pair of pin apertures 42, and has a hooked distal end 62. The hooked distal end 62 of each of the pair of locking pins has an outer facet 64 and extending perpendicularly in towards the other locking pin 58. The pair of locking pins 58 move together and alternatively move apart between a closed position and an alternative open position as the screw gear 56 is rotated in each direction. A width of the each of the pair of pin apertures 42 must be greater than a length of the hooked distal end 62 of each of the pair of locking pins 58 to allow for sufficient travel.

A microprocessor 66 is coupled within the frontside inner cavity 26 between the battery compartment 44 and the inner wall 36. The microprocessor 66 is in operational communication with the motor 54. A plurality of batteries 68 is coupled within the battery compartment 44 of the frontside inner cavity and is in operational communication with the motor 54 and the microprocessor 56. A fingerprint scanner 70 is coupled within the frontside inner cavity 26 and has a scan side 72 extending through the frontside back face 22. The scan side 72 is oriented parallel to the angled portion 34 of the frontside top face to be used most naturally while gripping the gun 40. The fingerprint scanner 70 is in operational communication with the microprocessor 56 to activate the motor 54 to turn the screw gear 56 and separate the pair of locking pins 58 to the open position when an authorized fingerprint is touched to the scan side 72.

A backside body 74 has a backside outer face 76 separated from a backside inner face 78, a backside top face 80 separated from a backside bottom face 82, and a backside back face 84 separated from a backside front face 86 defining a backside inner cavity 88. The backside body 74 conforms to the shape of the frontside body 12 except the backside inner face 78 lies in a single plane. The backside inner face 78 has a pair of receiving apertures 90 extending through to the backside inner cavity 88 to selectively receive the pair of locking pins 58. The pair of locking pins 58 secures a median portion 92 between the pair of receiving apertures 90 in the closed position and presses the extended portion 28 of the frontside inner face against the backside inner face 78. The frontside body 12 the backside body 74 are configured to secure each side of the trigger guard 38 with the pair of locking pins 58 extending around each side of a trigger 94 of the gun to prevent the gun 40 from being fired. The pair of locking pins 58 is removable from the pair of receiving apertures 90 in the open position to separate the frontside body 12 and the backside body 74.

In use, the frontside body 12 and the backside body 74 are placed on each side of the gun 40 with the pair of locking pins 58 extending around each side of the trigger 94. When the pair of locking pins 58 enters the pair of receiving apertures 90 the fingerprint scanner 70 is used to move the locking pins 58 to the closed position and lock the apparatus 10. The fingerprint scanner 70 is then used again to move the locking pins 58 to the open position and free the backside body 74 from the frontside body 12 to unlock the gun 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A fingerprint gun lock apparatus comprising:

a frontside body, the frontside body having a frontside outer face separated from a frontside inner face, a frontside top face separated from a frontside bottom face, and a frontside back face separated from a frontside front face defining a frontside inner cavity, the frontside inner face having an extended portion adjacent the frontside front face and a recessed portion adjacent the frontside back face, the extended portion having an inner wall parallel with the frontside front face, the inner wall having a length configured to be greater than a width of a trigger guard of a gun, the recessed portion of the frontside inner face having a pair of pin apertures extending through to the frontside inner cavity;

a motor coupled to the frontside body, the motor being coupled within the frontside inner cavity;

a screw gear coupled to the motor, the screw gear extending into the recessed portion and being in operational communication with the motor;

a pair of locking pins coupled to the screw gear, the pair of locking pins each having a threaded end coupled to the screw gear, extending through the pair of pin apertures, and having a hooked distal end, the pair of locking pins moving together and alternatively moving apart between a closed position and an alternative open position as the screw gear is rotated;

a microprocessor coupled to the frontside body, the microprocessor being coupled within the frontside inner cavity and being in operational communication with the motor;

a plurality of batteries coupled to the frontside body, the plurality of batteries being coupled within the frontside inner cavity and being in operational communication with the motor and the microprocessor;

a fingerprint scanner coupled to the frontside body, the fingerprint scanner being coupled within the frontside inner cavity and having a scan side extending through the frontside back face, the fingerprint scanner activating the motor to turn the screw gear and separate the pair of locking pins to the open position when an authorized fingerprint is touched to the scan side, the fingerprint scanner being in operational communication with the microprocessor; and a backside body, the backside body having a backside outer face separated from a backside inner face, a backside top face separated from a backside bottom face, and a backside back face separated from a backside front face defining a backside inner cavity, the backside inner face having a pair of receiving apertures extending through to the backside inner cavity, the pair of receiving apertures selectively receiving the pair of locking pins, the pair of locking pins securing a median portion between the pair of receiving apertures in the closed position and pressing the extended portion of the frontside inner face against the backside inner face, the pair of locking pins being removable from the pair of receiving apertures in the open position;

wherein the frontside body and the backside body are configured to secure each side of the trigger guard with the pair of locking pins extending around each side of a trigger of the gun to prevent the gun from being fired.

2. The fingerprint gun lock apparatus of claim 1 further comprising the hooked distal end of each of the pair of locking pins extending perpendicularly in towards the other locking pin.

3. The fingerprint gun lock apparatus of claim 2 further comprising the hooked distal end of each of the pair of locking pins having an outer facet.

4. The fingerprint gun lock apparatus of claim 1 further comprising the frontside inner cavity having a battery compartment within the extended portion, the plurality of batteries being coupled within the battery compartment, the frontside inner face having a battery aperture extending through to the battery compartment, a battery cover being selectively engageable with the battery aperture to cover and alternatively expose the battery compartment.

5. The fingerprint gun lock apparatus of claim 4 further comprising the microprocessor being coupled between the battery compartment and the inner wall.

6. The fingerprint gun lock apparatus of claim 4 further comprising the battery cover being circular and having a fastener extension, the fastener extension receiving a fastener to selectively engage the frontside inner face.

7. The fingerprint gun lock apparatus of claim 1 further comprising the frontside top face having a parallel portion and an angled portion, the parallel portion being parallel the frontside bottom face and extending along the recessed portion and the angled portion extending towards the frontside bottom face along the extended portion.

8. The fingerprint gun lock apparatus of claim 7 further comprising the scan side of the fingerprint scanner being oriented parallel to the angled portion of the frontside top face.

9. A fingerprint gun lock apparatus comprising:

a frontside body, the frontside body having a frontside outer face separated from a frontside inner face, a frontside top face separated from a frontside bottom face, and a frontside back face separated from a frontside front face defining a frontside inner cavity, the frontside inner face having an extended portion adjacent the frontside front face and a recessed portion adjacent the frontside back face, the frontside top face having a parallel portion and an angled portion, the parallel portion being parallel the frontside bottom face and extending along the recessed portion and the angled portion extending towards the frontside bottom face along the extended portion, the extended portion having an inner wall parallel with the frontside front face, the inner wall having a length configured to be greater than a width of a trigger guard of a gun, the recessed portion of the frontside inner face having a pair of pin apertures extending through to the frontside inner cavity, the frontside inner cavity having a battery compartment within the extended portion, the frontside inner face having a battery aperture extending through to the battery compartment;

a battery cover coupled to the frontside body, the battery cover being circular and having a fastener extension, the fastener extension receiving a fastener to selectively engage the frontside inner face, the battery cover being selectively engageable with the battery aperture to cover and alternatively expose the battery compartment;

a motor coupled to the frontside body, the motor being coupled within the frontside inner cavity;

a screw gear coupled to the motor, the screw gear extending into the recessed portion and being in operational communication with the motor;

a pair of locking pins coupled to the screw gear, the pair of locking pins each having a threaded end coupled to the screw gear, extending through the pair of pin apertures, and having a hooked distal end, the hooked distal end of each of the pair of locking pins having an outer facet and extending perpendicularly in towards the other locking pin, the pair of locking pins moving together and alternatively moving apart between a closed position and an alternative open position as the screw gear is rotated;

a microprocessor coupled to the frontside body, the microprocessor being coupled within the frontside inner cavity between the battery compartment and the inner wall, the microprocessor being in operational communication with the motor;

a plurality of batteries coupled to the frontside body, the plurality of batteries being coupled within the battery compartment of the frontside inner cavity and being in operational communication with the motor and the microprocessor;

a fingerprint scanner coupled to the frontside body, the fingerprint scanner being coupled within the frontside inner cavity and having a scan side extending through the frontside back face, the scan side being oriented parallel to the angled portion of the frontside top face, the fingerprint scanner activating the motor to turn the screw gear and separate the pair of locking pins to the open position when an authorized fingerprint is touched to the scan side, the fingerprint scanner being in operational communication with the microprocessor; and a backside body, the backside body having a backside outer face separated from a backside inner face, a backside top face separated from a backside bottom face, and a backside back face separated from a backside front face defining a backside inner cavity, the backside inner face having a pair of receiving apertures extending through to the backside inner cavity, the pair of receiving apertures selectively receiving the pair of locking pins, the pair of locking pins securing a median portion between the pair of receiving apertures in the closed position and pressing the extended portion of the frontside inner face against the backside inner face, the pair of locking pins being removable from the pair of receiving apertures in the open position;

wherein the frontside body and the backside body are configured to secure each side of the trigger guard with the pair of locking pins extending around each side of a trigger of the gun to prevent the gun from being fired.

* * * * *